US012123133B2

(12) United States Patent
Eryilmaz et al.

(10) Patent No.: US 12,123,133 B2
(45) Date of Patent: Oct. 22, 2024

(54) PROCESS FOR PREPARING A COMPOSITE TEXTILE ARTICLE INCLUDING A BIOPOLYMER LAYER

(71) Applicant: Sanko Tekstil Isletmeleri San. Ve Tic. A.S., Bursa (TR)

(72) Inventors: Jitka Eryilmaz, Bursa (TR); Ertug Erkus, Bursa (TR); Ozgur Cobanoglu, Bursa (TR); Leyla Zengi, Bursa (TR); Ece Senel, Bursa (TR)

(73) Assignee: SANKO TEKSIL ISELETMELERI SAN. VE TIC. A.S., Bursa (TR)

( * ) Notice: Subject to any disclaimer, the term of this patent is extended or adjusted under 35 U.S.C. 154(b) by 0 days.

(21) Appl. No.: 16/168,938

(22) Filed: Oct. 24, 2018

(65) Prior Publication Data

US 2019/0127907 A1 May 2, 2019

(30) Foreign Application Priority Data

Oct. 27, 2017 (EP) ..... 17198751

(51) Int. Cl.

| | |
|---|---|
| ***D06M 15/05*** | (2006.01) |
| ***D06M 15/03*** | (2006.01) |
| ***D06M 15/15*** | (2006.01) |
| ***D06M 15/643*** | (2006.01) |
| ***D06M 16/00*** | (2006.01) |
| ***D06N 3/00*** | (2006.01) |
| ***D06P 1/22*** | (2006.01) |
| ***D06P 1/46*** | (2006.01) |
| ***D06P 1/48*** | (2006.01) |
| ***D06P 1/50*** | (2006.01) |
| ***D06P 3/60*** | (2006.01) |

(52) U.S. Cl.

CPC ..... *D06M 16/003* (2013.01); *D06M 15/03* (2013.01); *D06M 15/05* (2013.01); *D06M 15/15* (2013.01); *D06M 15/643* (2013.01); *D06M 15/6436* (2013.01); *D06N 3/0018* (2013.01); *D06N 3/0088* (2013.01); *D06N 3/009* (2013.01); *D06P 1/228* (2013.01); *D06P 1/46* (2013.01); *D06P 1/48* (2013.01); *D06P 1/50* (2013.01); *D06P 3/6025* (2013.01); *D06M 2200/50* (2013.01); *D06N 2203/024* (2013.01); *D06N 2203/026* (2013.01); *D06N 2211/10* (2013.01); *D10B 2401/061* (2013.01); *D10B 2501/00* (2013.01)

(58) Field of Classification Search

CPC ..... D06M 16/003; D06M 15/03; D06M 15/6436; D06M 15/643; D06M 15/05; D06M 15/15; D06M 2200/50; D06P 1/48; D06P 3/6025; D06P 1/228; D06P 1/50; D06P 1/46; D06N 3/0088; D06N 3/009; D06N 3/0018; D06N 2203/024; D06N 2211/10; D06N 2203/026; D10B 2401/061; D10B 2501/00

See application file for complete search history.

(56) References Cited

U.S. PATENT DOCUMENTS

| | | | | |
|---|---|---|---|---|
| 4,378,431 A | | 3/1983 | Brown, Jr. | |
| 5,514,737 A | | 5/1996 | Sano et al. | |
| 6,040,251 A | * | 3/2000 | Caldwell | A61F 13/53704 428/305.5 |

FOREIGN PATENT DOCUMENTS

| | | | | |
|---|---|---|---|---|
| CN | 102619088 | | 8/2012 | |
| CN | 106087451 | | 11/2016 | |
| CN | 106087451 | A * | 11/2016 | |
| EP | 0396344 | | 11/1990 | |
| EP | 3205668 | A1 | 8/2017 | |
| JP | 09279483 | A * | 10/1997 | |
| JP | H09279483 | | 10/1997 | |
| JP | 2009102755 | | 5/2009 | |
| WO | 2014182536 | | 11/2014 | |
| WO | 2016073453 | | 5/2016 | |
| WO | 2016120042 | A1 | 8/2016 | |
| WO | WO-2016162657 | A1 * | 10/2016 | C12N 1/00 |
| WO | 2017053433 | | 3/2017 | |
| WO | 2017186583 | | 11/2017 | |
| WO | 2017186584 | | 11/2017 | |

OTHER PUBLICATIONS

Hashem, M. et al., An eco-friendly-novel approach for attaining wrinkle-free/soft-hand cotton fabric, 2009, Carbohydrate Polymers, 78, 690-703 (Year: 2009).*

Goddeeris, C. et al., Light scattering measurements on microemulsions: Estimation of droplet sizes, 2006, International Journal of Pharmaceutics, 312, 187-195 (Year: 2006).*

Montazer, M. et al., Application of Polyurethane/Citric Acid/Silicone Softener Composite on Cotton/Polyester Knitted Fabric Producing Durable Soft and Smooth Surface, 2011, Journal of Applied Polymer Science, 124: 4141-4148 (Year: 2011).*

Yang, L. et al. Study on the properties of silicon-modified polyurethane anticorrosion coating, 2017, Chemical Engineering Transactions, 59: 103-108 (Year: 2017).*

Araujo, S. et al. The Role of Technology Towards a New Bacterial-Cellulose-based Material for Fashion Design, 2015, Journal of Industrial and Intelligent Information, 3(2): 168-172 (Year: 2015).*

(Continued)

*Primary Examiner* — Louise W Humphrey

*Assistant Examiner* — Anjali Ajit Hirani

(57) ABSTRACT

A process for the production of a composite textile article which includes at least a biopolymer layer, comprising the following steps: providing at least one textile article, in particular selected from a fiber, a yarn, a fabric and a garment; providing at least part of the textile article with at least a biopolymer layer; providing at least part of the biopolymer layer with at least a textile softening agent, to provide a composite textile article; and to a composite textile article as obtainable therefrom.

15 Claims, No Drawings

(56) References Cited

OTHER PUBLICATIONS

Otaigbes, J., et al. The processing, structure and properties of elastomeric fibers, 2009, Handbook of Textile Fibre Structure, vol. 1, Chapter 11, 325-351 (Year: 2009).*
Database WPI Week 201714 Thomson Scientific, London, GB; AN2016-71230R XP002779781.
Database WPI Week 201323 Thomson Scientific, London, GB; AN2012-M87863 XP002779782.
Database WPI Week 200934 Thomson Scientific, London, GB; AN2009-J25752 XP002779783.
European Search Report and Written Opinion issued on Apr. 6, 2018 for European Priority Application No. 17198751.4.
Meftahi, A. et al., "The effects of cotton gauze coating with microbial cellulose" Cellulose, Voi. 17, Nov. 21, 2009.
European Search Report and Written Opinion issued on Mar. 29, 2019 for corresponding European Application No. 18202976.9.
Notice of Opposition with facts and arguments filed at the EPO by Troesch Scheidegger Werner AG on Jun. 16, 2021 for corresponding European Patent No. 3476996 (application No. 18202976.9).
Decision and Minutes issued bt the EPO on Feb. 22, 2023 for corresponding EP 3476996.
Mohamed Hashem, "An eco-friendly-novel approach for attaining wrinkle-free/soft-hand cotton fabric", Carbohydrate Polymers, Carbohydrate Polymers 78 (2009) 690-703, Available online Jun. 7, 2009, Elsevier.
Office Action issued by the CN paten office on Apr. 22, 2022 for corresponding CN application No. 201811257368.0.
Test results filed as "Exhibit 4" by the Representative of the Patent Proprietor on Nov. 17, 2022 in opposition proceedings with the EPO for corresponding EP 3476996.
Proprietor response filed at the EPO on Dec. 7, 2021 in response to the Notice of Opposition filed against EP n. 3476996.
Proprietor's submissions filed at the EPO on Nov. 17, 2022 during opposition proceedings for EP No. 3476996.
Silicone—Britannica Online Encyclopedia, https://www.britannica.com/print/article/544410, retreived Nov. 29, 2021.
Silvia Araujo, "The Role of Technology Towards a New Bacterial-Cellulose-based Material for Fashion Design", Journal of Industrial and Intelligent Information vol. 3, No. 2, Jun. 2015.
Stefan-Ovidiu Dima et al., "BacterialNanocellulosefromSide-Streamsof KombuchaBeveragesProduction: Preparationand Physical-ChemicalProperties", Published: Aug. 18, 2017, Polymers 2017,9,374, http://www.mdpi.com/journal/polymers.
Submissions filed at the EPO by the Opponent Troesch on Nov. 15, 2022 in opposition proceedings against EP No. 3476996.
Summons to attend Oral proceedings issued by the EPO on Jul. 7, 2022 for corresponding EP No. 3476996.

* cited by examiner

PROCESS FOR PREPARING A COMPOSITE TEXTILE ARTICLE INCLUDING A BIOPOLYMER LAYER

THIS NON-PROVISIONAL APPLICATION claims priority to and the benefit of European Application No. 17198751.4 filed on Oct. 27, 2017, the content of which is incorporated herein by reference in its entirety.

FIELD OF THE INVENTION

The present invention relates to the textile field, in particular to composite textile articles comprising a biopolymer. Specifically, the present invention relates to a process for the production of composite textile articles, such as yarns and fabrics, comprising a biopolymer, to a composite textile article obtained with said process and to clothing articles, i.e. garments, including said composite textile article.

BACKGROUND OF THE INVENTION

Composite textiles, are textiles that comprise two or more constituent materials with different physical or chemical properties that, when combined, produce a material, e.g. a fabric, with characteristics different from the individual components. Generally, the individual components substantially remain separate and distinct within the finished structure.

Composite textiles wherein a base textile article, e.g. a fabric, is coupled with a biopolymer, are known. Bacterial cellulose is a known biopolymer for use in textiles. Bacterial cellulose and biopolymers in general are applied to a textile in several known ways, e.g. by spraying, impregnation, culturing the bacteria or microorganisms producing the biopolymer on yarns or fabric, etcetera.

In the final product, the biopolymer will adhere to at least the surface of the textile substrate; in following description the biopolymer attached to the substrate will be referred to as a biopolymer "layer". However the wording "layer" should be interpreted in its wider meaning of a biopolymer located at least on the surface of a textile, independently on its amount, shape and extension. In embodiments, the biopolymer may extend below the surface of the textile e.g. may also be impregnating at least part of the textile fibers.

The bacterial cellulose is an organic compound with the formula $(C_6H_{10}O_5)_n$, the same of plant cellulose, that is produced from certain types of bacteria as extracellular polymer.

Although the bacterial cellulose has the same molecular formula of the plant cellulose, it differs from the latter one in macromolecular properties. In fact, bacterial cellulose, with respect to plant cellulose, is generally free from hemicellulose or lignin, and it has a higher water holding capacity, a greater tensile strength, a higher degree of polymerization and a higher crystallinity.

Due to these peculiar properties, the bacterial cellulose has been applied in several technical fields, such as food industry, medical field (e.g. as wound dressing and in blood vessel regeneration) and, as above mentioned, in the field of textiles.

For example, JPH09279483 discloses a fujiette fabric treated with a culture medium for a cellulose-producing microorganism, and the cellulose-producing microorganism is cultured on the surface of the rayon filaments constituting the fabric. In this way, a layer of bacterial cellulose is provided to the rayon filaments constituting the fabric.

PCT/EP2017/059477 and PCT/EP2017/059471, both in the name of the present applicant, disclose methods of growing bacterial cellulose on textiles, such as fabrics, yarns and fibers.

CN106087451A discloses the preparation of air permeable polyurethane synthetic leather. The preparation involves producing a polyether-modified amino silicone oil mixture, reacting the mixture to obtain colloid which is polyether amino silicone modified polyurethane, obtaining an *Acetobacter* saccharose solution, mixing the modified polyether type silicone oil-modified polyurethane with the *Acetobacter* saccharose solution and other ingredients to obtain bacterial cellulose, and mixing modified polyether amino silicone oil modified polyurethane, bacterial cellulose, deionized water and sodium dodecylbenzensulphonate to obtain a slurry, and finally coating slurry evenly on a single sided velvet cloth, solidifying coated cloth.

EP0396344A2 discloses a hollow microbial cellulose comprising a cellulose produced by a microorganism. The hollow microbial cellulose may be used as an immobilizing carrier for various enzymes, microorganisms and cells, a tubular industrial material, a medical material, a chemical material and the like. For example, EP0396344A2 discloses that, in the medical field, the hollow microbial cellulose can be used as a substitute for an internal hollow organ such as the ureter, the trachea, a digestive tract, a lymphatic vessel or a blood vessel. EP0396344A2 discloses that the hollow microbial cellulose may be obtained by culturing a cellulose-producing microorganisms on the inner surface and/or outer surface of an oxygen-permeable hollow carrier composed of, for example a woven fabric. According to EP0396344A2, an exemplary hollow carrier may be a cylindrical cotton fabric. The fabrics of EP0396344A2 are not suitable for the production of garments.

U.S. Pat. No. 5,514,737A discloses a fiber treatment composition containing a synthetic resin emulsion and a pulverized hydrophilic organic natural material, for example, pulverized animal protein such as collagen, elastin, silk powder and sponge powder and wool, and pulverized plants like cellulose, such as cotton, hemp, pulp and seaweed.

CN102619088A discloses a softening agent capable of improving the sublimation fastness of a disperse dye and the wet friction fastness of a reactive dye. The softening agent comprises palmitic acid ethyl ester group quaternary ammonium salt, chitosan, polyvinyl pyrrolidone, polyether modified silicone oil, ternary copolymer block silicon oil, collagen protein and pure water.

U.S. Pat. No. 4,378,431A discloses a method of enhancing the hydrophilic characteristics of hydrophilic substances (e.g. cotton or paper) by incubating a culture medium inoculated with an *Acetobacter* bacterium capable of synthesizing cellulose microfibrils, in the presence of a natural substrate, whereby cellulose microfibrils are produced on and attached to the surface of the substrate. Suitable natural substrates include materials such as cotton (e.g. to increase the hydrophilic nature).

However, known composite fabrics comprising a biopolymer layer, in particular those composite fabrics for the production of clothing articles, have several drawbacks. One of the drawbacks is the biopolymer layer partly detaching or delaminating from the fabric under stress.

For example, a layer of bacterial cellulose could easily undergo tearing or cracking, and a possible detachment from the fabric, for example when it is washed.

Moreover, if an intrinsically non elastic biopolymer layer, such as a bacterial cellulose layer, is provided to a stretchable fabric, e.g. an elastic fabric, stretching of the fabric may be sufficient to tear or crack the bacterial cellulose layer.

Furthermore, complex processes are required to provide known composite fabrics comprising a biopolymer layer with aesthetical fashionable effects and pleasant touch, required in the production of clothing articles and garments.

SUMMARY OF THE INVENTION

It is an aim of the present invention to solve the above mentioned problems and to provide a process for the production of a composite textile article comprising a biopolymer layer, wherein the tearing and cracking of the biopolymer layer are substantially reduced or avoided, even when the composite article is stretched.

Another aim of the present invention is to provide a process for the production of a composite textile article, e.g. a fabric, which comprises a biopolymer layer and having a fashionable appearance and pleasant touch, and that is therefore suitable to be used in the production of garments for daily life.

Still another aim of the present invention is to provide a process for the production of a composite textile article comprising a biopolymer layer that is not expensive and can be performed easily and quickly.

These and other aims are achieved by the disclosed process, which results in the production of a composite textile article. It is thus an object of the present invention a process for the production of a composite textile article which includes at least a biopolymer layer, comprising the following steps:

a. Providing at least one textile article;
b. Providing at least part of the textile article with at least a biopolymer layer;
c. Providing at least part of the biopolymer layer with at least a textile softening agent, to provide a composite textile article.

It is also an object of the present invention a composite textile article as obtainable with a process according to the invention, wherein the composite textile article includes a textile softening agent.

DETAILED DESCRIPTION

In the following description, the features of the invention will be described with reference to exemplary embodiments; however any feature of the invention disclosed herein, may be combined with one or more other features here disclosed to provide further embodiments of the present invention. Such embodiments shall be considered as disclosed by the present application.

As above mentioned, an object of the present invention is a process for the production of a composite textile article which includes at least a biopolymer layer, comprising the following steps:

a. Providing at least one textile article;
b. Providing at least part of the textile article with at least a biopolymer layer;
c. Providing at least part of the biopolymer layer with at least a textile softening agent, to provide a composite textile article.

In fact, it was surprisingly found that, through the process of the invention, a composite textile article comprising a biopolymer layer, for example a composite fabric comprising a biocellulose layer, can be obtained, wherein the tearing and cracking of the biopolymer layer is substantially reduced or prevented.

In other words, through the process of the invention, a composite textile article comprising a biopolymer layer can be obtained, wherein the composite textile article (i.e., at least part of the biopolymer layer of the composite article) includes a textile softening agent, and wherein the composite article can withstand stresses such as washing and/or stretching, so that the integrity of the composite textile article, in particular the integrity of the biopolymer layer of the composite article, is preserved.

Advantageously, the structural integrity of the biopolymer layer of the composite article of the invention, which is provided with a textile softening agent, is not jeopardized when a composite textile article according to the invention is subjected to a stress, such as washing and/or stretching. In particular, in a composite textile article according to the invention, the tearing and cracking of the biopolymer layer are substantially avoided, so that the risk of detachment of the biopolymer layer from the "base" textile article (e.g., caused by cracking of the biopolymer layer) is substantially negligible.

Advantageously, according to embodiments of the present invention, the textile article may be an elastic textile article, i.e. a stretchable textile article.

According to embodiments, step b. of the process according to the invention is carried out by contacting at least part of said textile article with a culture comprising biopolymer-producing microorganisms, and culturing said biopolymer-producing microorganisms, to provide at least part of said textile article with a biopolymer layer.

In other words, step b. of the process according to the invention, can be carried out by "growing" (i.e. producing) the biopolymer layer directly on the textile article, e.g. directly on a fabric.

For example, the front side and/or the back side of a woven fabric can be contacted with a culture including biopolymer-producing microorganisms, so that biopolymer-producing microorganisms can be cultured onto the front side and/or the back side of the fabric. More in detail, once the woven fabric is contacted with a culture of biopolymer-producing microorganisms, biopolymer-producing microorganisms are cultured, to produce a layer of biopolymer directly on the fabric, thus providing the fabric with at least a layer of biopolymer.

According to embodiments, a biopolymer can be produced (i.e. "grown") on at least part of a yarn by contacting said yarn, with a culture of biopolymer-producing microorganisms, and culturing said biopolymer-producing microorganisms, before the weaving, thus providing "composite yarns", i.e. yarns provided with a biopolymer layer.

According to embodiments of the invention, "composite yarns", as above defined, may be woven to provide a woven fabric provided with a biopolymer layer.

According to embodiments, a biopolymer can be produced (i.e. "grown") on at least part of a garment by contacting said garment, with a culture of biopolymer-producing microorganisms, and culturing said biopolymer-producing microorganisms, thus providing a "composite garment", i.e. a garment wherein at least part of the garment is provided with a biopolymer layer.

According to embodiments, step b. of the process according to the invention, may be carried out by contacting at least part of said textile article with a culture which includes biopolymer-producing microorganisms and further comprises a textile softening agent, to provide at least part of the biopolymer layer, which is produced by biopolymer-producing microorganisms, with a textile softening agent.

In other words, when the culture including biopolymer-producing microorganisms further comprises a textile softening agent, a biopolymer (i.e., a biopolymer layer) including a softening agent can be obtained.

According to embodiments, when the culture including biopolymer-producing microorganisms, further comprises a textile softening agent, step b. and step c. according to the process of the invention, can be performed substantially simultaneously, i.e., according to a "one step" process.

In particular, when the culture including biopolymer-producing microorganisms further comprises a textile softening agent, a biopolymer layer including a softening agent can be produced (i.e., "grown") directly on the textile article.

According to embodiments, the biopolymer layer including a textile softening agent is produced (i.e., "grown") directly on the textile article.

For example, a textile article, e.g., a fabric, may be contacted on its front side and/or its back side with a culture comprising biopolymer-producing microorganisms, for example biopolymer-producing bacteria, to produce a layer of biopolymer, for example a layer of bacterial cellulose, directly on the fabric, thus providing the fabric with at least a layer of biopolymer (e.g., bacterial cellulose), as above mentioned. In the case that, according to embodiments, the culture of biopolymer-producing microorganisms (e.g., biopolymer-producing bacteria) further comprises a textile softening agent, a biopolymer layer (e.g., a bacterial cellulose layer) including at least part of said textile softening agent can be obtained, directly on the front side and/or the back side of the fabric.

Without being bound to a specific scientific explanation, it has been observed that, in the case that the culture of biopolymer-producing microorganisms further comprises a textile softening agent, when the biopolymer-producing microorganisms are cultured, at least part of the textile softening agent which is present in the culture (i.e., in the culture medium) is incorporated into the "growing" biopolymer layer.

For example, in the case that a culture of bacterial cellulose-producing bacteria further comprises a textile softening agent, when the cellulose-producing bacteria are cultured, at least part of the textile softening agent which is present in the culture (i.e., in the culture medium) is incorporated into the "growing" bacterial cellulose layer.

For example, a bacterial cellulose layer, can be produced by culturing strains of *Acetobacter* bacteria, such as strains of *Acetobacter xylinum*, and/or by culturing strains of *Gluconacetobacter*, such as strains of *Gluconacetobacter hansenii*.

In other words, advantageously, a composite textile article according to the invention, can be obtained by a process comprising the steps of providing a textile article; contacting at least part of said textile article with a culture comprising biopolymer-producing microorganisms and at least a textile softening agent; and culturing said biopolymer-producing microorganisms in order to provide the textile article with a biopolymer layer, which includes a textile softening agent, and which is produced (i.e., "grown") directly on the textile article.

According to embodiments, when the culture including biopolymer-producing microorganisms further comprises a textile softening agent, said culture comprises said textile softening agent in an amount ranging from 0.5% to 2% by weight, preferably from 0.8 to 1.2% by weight of the final culture weight that is applied to the textile.

According to embodiments, step c. of the process according to the invention is carried out by contacting the textile article provided with at least a biopolymer layer, obtained with step b., i.e. a textile article including a biopolymer layer, with at least a mixture comprising a textile softening agent. In other words, in these embodiments, step b. and step c. of the process of the invention may be carried out sequentially, i.e., step c. is carried out after step b. In fact, according to embodiments of the invention, a textile article is provided with a biopolymer layer and, subsequently, at least part of the biopolymer layer is provided with a textile softening agent. Preferably, at least part of the biopolymer layer of the composite textile article obtained in step b. of the process of the invention, is contacted with at least a mixture comprising a textile softening agent, so that the biopolymer layer is provided with a textile softening agent.

For example, a textile article, e.g., a fabric, may be contacted with a culture comprising biopolymer-producing microorganisms, for example biopolymer-producing bacteria, to produce a layer of biopolymer, for example a layer of bacterial cellulose, directly onto the fabric, thus providing the fabric with a layer of biopolymer (i.e. a biopolymer layer, for example a bacterial cellulose layer), as above mentioned. According to embodiments, after the biopolymer layer has been provided to the fabric, the "composite fabric" (i.e., the fabric provided with a biopolymer layer) so obtained is contacted with a textile softening agent, e.g. a mixture comprising a textile softening agent, to provide at least part of the biopolymer layer with said textile softening agent.

According to embodiments, at least part of the biopolymer layer may be impregnated with a textile softening agent, preferably with a mixture including a textile softening agent.

According to embodiments, a composite textile article as obtained after step b., e.g., a textile article provided with at least a biopolymer layer, is impregnated with a mixture including a textile softening agent. In this case, advantageously, both the textile article and the biopolymer layer are provided with a textile softening agent, so that both the textile article and the biopolymer layer in the composite textile article include a textile softening agent.

According to embodiments, step c. of the process according to the invention is carried out by contacting the textile article provided with at least a biopolymer layer obtained with step b., i.e. a composite textile article at least in part including a biopolymer layer, with at least a mixture comprising a textile softening agent, wherein the mixture comprises a textile softening agent in an amount ranging from 5% to 50%, more preferably 10% to 40%, even more preferably 10% to 30% by weight of the final mixture weight.

According to embodiments, the textile softening agent is selected from cationic, non-ionic, anionic and amphoteric textile softeners, and preferably is a cationic softening agent. According to preferred embodiments, the textile softening agent is a silicone softening agent, most preferably a micro-silicone agent.

Suitable microorganism for the invention are e.g. those disclosed in above cited PCT/EP2017/059477 (WO2017/186584A1) and PCT/EP2017/059471 (WO2017/186583A1), in the name of the present Applicant.

According to embodiments, the textile article (e.g., a fabric) may be contacted with a culture of biopolymer-producing microorganisms, which can optionally include a textile softening agent, by dipping the textile article into the culture of biopolymer-producing microorganisms.

In other words, according to embodiments, at least part of the textile article may be contacted, with a culture of microorganisms producing a biopolymer, by dipping at least part of said textile article into said culture of biopolymer-producing microorganisms. As above mentioned, the culture of biopolymer-producing microorganisms may optionally include a textile softening agent, preferably a silicone softening agent.

Advantageously, when the textile article is dipped into the culture of biopolymer-producing microorganisms, the biopolymer layer grows substantially on the entirety of the portion of the textile article that is dipped into the culture. For example, when a fabric, e.g., a woven fabric, is dipped into a culture of biopolymer-producing microorganisms, the biopolymer layer grows substantially on both the sides (i.e. the front side and the back side of the woven fabric), thus providing a composite fabric wherein the woven fabric is provided with two biopolymer layers, which comprise the same biopolymer.

According to embodiments, the culture of biopolymer-producing microorganisms, optionally including a textile softening agent, preferably a silicone softening agent, is poured or sprayed on at least part of the textile article. Silicone and micro-silicone showed to be specifically useful softening agents in this embodiment.

Advantageously, when the culture of biopolymer-producing microorganisms is poured or sprayed onto at least part of a textile article, the biopolymer layer grows substantially only on the portion of the textile article wherein the culture is poured or sprayed. For example, when a culture of biopolymer-producing microorganisms is poured or sprayed onto the front side or the back side of a fabric, e.g., a woven fabric, the biopolymer layer grows substantially only on the side (i.e. the front side or the back side of the woven fabric) wherein the culture is poured or sprayed, thus providing a composite fabric wherein the woven fabric is provided with a biopolymer layer only on its front side or on its back side.

As above mentioned, through the process of the invention, a composite textile article, e.g., a composite fabric, including a biopolymer layer and a textiles softening agent, wherein the composite article can withstand stresses such as washing and/or stretching, so that the integrity of the composite textile article, particularly the integrity of the biopolymer layer of the composite article, is preserved, and the risk of detachment of the biopolymer layer (e.g., caused by cracking) is substantially negligible, can be obtained.

This is particularly true when, according to preferred embodiments, the textile softening agent is a silicone softening agent.

In fact, it has been surprisingly observed that, when at least part of the composite textile article including a biopolymer layer is provided with a silicone softening agent, the stiffness of the composite textile article is decreased (with respect to a composite fabric including a biopolymer layer which is not provided with a silicone softening agent); in particular, the biopolymer layer results to be particularly flexible, so that tearing and cracking of the biopolymer layer is substantially avoided, even in case of, for example, multiple stretching of the composite textile article.

Also, when the composite textile is provided with a silicone softening agent, i.e., when at least part of the biopolymer layer includes a silicone softening agent, advantageously, the detachment of the biopolymer layer from the textile article, for example during washing of the composite textile article, is substantially avoided.

Without being bound to a specific scientific explanation, a possible explanation is that by providing a silicone softening agent, the hydrophobicity of the biopolymer layer increases (in other words, the hydrophilicity of the biopolymer layer is reduced), so that the interaction between the biopolymer layer and the textile article in the composite textile article is substantially not jeopardized by and maintained during washing of the composite textile article.

Moreover, advantageously, when a composite textile according to the present invention includes a silicone softening agent, the composite textile article may be provided with a leather-like appearance and particularly with a soft touch, i.e., it results to have an appearance that is similar to the appearance of leather, and results to be particularly soft when it is touched by a user.

Without being bound to a specific scientific explanation, it has been observed that biopolymers, such as microbial cellulose, have a silicone uptake that is higher (about 25% higher) with respect to standard cellulose-based fibers used in textiles, such as cotton.

This is particularly true when the biopolymer is bacterial cellulose, i.e., microbial cellulose produced by bacteria.

According to preferred embodiments of the invention, the biopolymer layer is a bacterial cellulose layer.

According to preferred embodiments of the invention, the textile softening agent is silicone softening agent and the biopolymer layer is a bacterial cellulose layer.

For example, when a composite textile article including a biopolymer layer, such as microbial cellulose, preferably bacterial cellulose, is impregnated with a certain amount of a silicone softening agent, the biopolymer layer adsorbs a higher amount of silicone softening agent with respect to the "base" textile article. In this way, it is possible to provide the biopolymer layer with a leather-like appearance, without providing the same effect to the "base" textile article.

For example, a fabric comprising cotton yarns may be provided with a biopolymer layer, e.g., a microbial cellulose layer, preferably bacterial cellulose, on one of its sides, e.g., the front side, wherein at least the biopolymer layer includes a silicone softening agent. In this case, a composite fabric is obtained wherein at least the biopolymer layer on the front side, i.e. the side of the fabric that is visible when a garment comprising the composite fabric is worn, of the composite fabric is provided with a leather-like appearance. Accordingly, a garment having at least in part a leather-like appearance may be obtained through the process according to the invention.

As used herein, the terms "leather-like appearance" refer to a material which has appearance that is similar to the appearance of leather.

Advantageously, as above mentioned, when a composite textile according to the present invention includes a silicone softening agent, the composite textile article is provided with a particularly soft touch.

According to embodiments of the invention, a biopolymer layer (e.g., a bacterial cellulose layer) including a silicone softening agent, may be provided to the back side of a fabric, i.e., on the side of the fabric which is not visible when a garment comprising the composite fabric is worn. In this case, the skin of the user may be contacted by the biopolymer layer of the composite fabric, providing a particularly soft and pleasant touch to the skin of the user.

According to embodiments of the invention, a biopolymer layer including a textile softening agent, preferably a silicone softening agent, may be provided to both the front side and the back side of a fabric.

According to embodiments, the silicone softening agent is selected from the group consisting of macro-silicone, semi-micro silicone, micro-silicone and nano-silicone softening agents, and preferably is a micro-silicone softening agent.

According to preferred embodiments of the invention, the biopolymer layer is a bacterial cellulose layer and the textile softening agent is a micro-silicone softening agent.

As used herein, terms "macro-silicone", "semi-micro silicone", "micro-silicone" and "nano-silicone" refer to the size of the silicone particles in the silicone softening agents. In particular, these terms refers to the size of the silicone particles in a silicone emulsion softening agent, i.e. in a softening agent including a silicone emulsion, wherein the silicone is in the form of "macro-particles", "semi-micro particles", "micro-particles" or "nano-particles", respectively.

According to embodiments, the macro-silicone softening agent is a macro-silicone emulsion wherein macro-silicone has a particle size ranging from 300 nm to 120 nm, preferably from 300 nm to 150 nm, said particle size being measured by using Dynamic Light Scattering.

For example, CERAPERM® MN Liq. is an exemplary macro-silicone emulsion suitable to be used in the process of the invention.

According to embodiments, the semi-micro silicone softening agent is a semi-micro silicone emulsion wherein semi-micro silicone has a particle size ranging from 120 nm to 80 nm, said particle size being measured by using Dynamic Light Scattering.

According to embodiments, the micro-silicone softening agent is a micro-silicone emulsion wherein micro-silicone has a particle size ranging from below 80 nm to 10 nm, preferably from below 60 nm to 10 nm, more preferably ranging from 40 nm to 10 nm, said particle size being measured by using Dynamic Light Scattering.

For example, CERAPERM® 3P Liq. and SANSIL MIC 3145 are exemplary micro-silicone emulsions suitable to be used in the process of the invention.

According to embodiments, the nano-silicone softening agent is a nano-silicone emulsion wherein nano-silicone has a particle size below 10 nm, particle size being measured by using Dynamic Light Scattering.

For example, SANDOPERM® SE1 Oil Liq. is an exemplary nano-silicone emulsion suitable to be used in the process of the invention.

Dynamic Light Scattering is a technique that is known in the art, and that is used to determine the size distribution profile of small particles, such as, for example, "micro-particles" and "nano-particles".

According to embodiments, the silicone softening agent is a cationic silicone softening agent or a non-ionic silicone softening agent.

According to embodiments, the cationic silicone softening agent is an aminosilicone softening agent. As used herein, the term "aminosilicone" refers to a silicone that is modified with one or more amino-groups. According to embodiments, the aminosilicone softening agent is a micro-aminosilicone softening agent, i.e., a micro-silicone as above defined. Preferably, the micro-aminosilicone softening agent is a micro-aminosilicone emulsion wherein the micro-aminosilicone has a particle size ranging from below 80 nm to 10 nm, preferably from below 60 nm to 10 nm, more preferably ranging from 40 nm to 10 nm, said particle size being measured by using Dynamic Light Scattering.

According to embodiments, the biopolymer is selected from a sugar-based biopolymer, preferably microbial cellulose, more preferably bacterial cellulose, and an amino acid-based biopolymer, preferably microbial collagen, or a mixture thereof.

As used herein, the term "biopolymer layer", refer to a layer comprising at least one biopolymer.

As used herein, the term "biopolymer" refers to all the polymers the can be produced by a microorganism, i.e. to a "microbial biopolymer". For example, a "microbial biopolymer" may be a "bacterial biopolymer", i.e. a biopolymer produced by bacteria.

As used herein, the term "microorganism" refers to small unicellular or multicellular living organisms that are too small to be seen with naked eye but are visible under a microscope, and encompasses bacteria, yeast, fungi, viruses and algae. As used herein, the term "microorganism" encompasses not genetically modified (i.e. wild type) microorganisms and genetically modified microorganism as well.

As used herein, the term "bacterial biopolymer" refers to a polymer that can be produced by bacteria, i.e., by biopolymer-producing bacteria.

As used in the present description, the term "sugar-based biopolymer" encompasses linear and branched polysaccharides, variants and derivatives thereof. An exemplary sugar-based biopolymer according to the present invention is microbial cellulose, preferably bacterial cellulose.

As used in the present description, the term "amino-acid based biopolymer" encompasses linear and branched polypeptides, variants and derivatives thereof. An exemplary amino acid-based biopolymer according to the present invention is microbial collagen, preferably bacterial collagen.

According to embodiments of the invention, the microbial biopolymer is selected from the group consisting of microbial cellulose, microbial collagen, microbial cellulose/chitin copolymer, microbial silk, and mixtures thereof. These biopolymers are known per se in the art.

According to embodiments of the invention, the bacterial biopolymer is selected from the group consisting of bacterial cellulose, bacterial collagen, bacterial cellulose/chitin copolymer, bacterial silk, and mixtures thereof.

Accordingly, a "biopolymer layer" as defined herein may comprise one or more microbial biopolymers selected from microbial cellulose, microbial collagen, microbial cellulose/chitin copolymer, microbial silk, and mixtures thereof. In embodiments, the "biopolymer layer" as defined herein may comprise one or more bacterial biopolymers selected from bacterial cellulose, bacterial collagen, bacterial cellulose/chitin copolymer, bacterial silk, and mixtures thereof.

According to embodiments, the biopolymer, i.e., the microbial biopolymer, is selected from microbial cellulose, microbial collagen or mixtures thereof.

According to embodiments of the invention, the textile article is selected from a fiber, a yarn, a fabric and a garment; preferably the textile article is a fabric, more preferably is a woven fabric, and even more preferably is a denim fabric. In other words, a textile article selected from a fiber, a yarn, a fabric and a garment may be used in the process according to the invention.

Suitable yarns may have linear density ranging from 60 dtex to 2000 dtex, preferably from 150 dtex to 1800 dtex, more preferably from 400 dtex to 1000 dtex.

According to embodiments, when the textile article is a fabric, the fabric has an surface area of at least 50 $cm^2$, preferably at least 100 $cm^2$, more preferably of 2500 $cm^2$.

Suitable garments may be tops such as shirts, blouses or jackets, or lower body apparel such as pants, slacks, shorts, leggings, culottes, tights or skirts. In other embodiments, the garments may be full body apparel such as a pant suit, gown, dress, or overalls, or any other garment. It should be understood that the disclosed invention is not limited to a particular type of garment.

Various manufacturing methods, per se known, may be used to form the garments.

According to embodiments, through the process of the invention, a composite fiber, or a composite yarn, or a composite fabric or a composite garment, including a biopolymer layer (e.g., bacterial cellulose layer) and provided with a textile softening agent (e.g., a silicone softening agent), may be obtained.

According to embodiments, a fabric may be provided with a biopolymer layer (e.g., bacterial cellulose layer) and a textile softening agent (e.g., a silicone softening agent), before or after being used in the production of a garment.

According to embodiments, the textile article may comprise natural fibers, synthetic fibers, regenerated fibers or mixtures thereof; for example, a yarn may comprise natural fibers, synthetic fibers, regenerated fibers or mixtures thereof.

According to embodiments, natural fibers are selected from cotton, wool, flax, kenaf, ramie, hemp, linen and mixtures thereof.

According to embodiments, synthetic fibers selected from polyester, rayon, nylon, lycra, elastane and mixtures thereof.

According to embodiments, regenerated fibers can be selected from lyocell, modal, viscose, bamboo, and mixtures thereof.

According to embodiments, the textile article comprises elastomeric fibers. As used herein, an "elastomeric fiber" is a fiber made of a continuous filament or a plurality of filaments which have an elongation at break of at least 100%, independent of any crimp. Break elongation may be measured e.g. according to ASTM D2256/D2256M-10 (2015). An "elastomeric fiber" is a fiber that after being stretched to twice its length and held for one minute at said length, will retract to less than 1.5 times its original length within one minute of being released.

According to embodiments, the textile article may be an elastic, i.e. a stretchable textile article, preferably comprising elastomeric yarns, i.e. yarns comprising elastomeric fibers.

According to embodiments, the textile article is an elastic textile article, i.e. a stretchable textile article, preferably an elastic fabric, more preferably an elastic woven fabric, even more preferably an elastic denim fabric.

According to embodiments, when the textile article is a woven fabric, weftwise elasticity values range from 10% to 50%, measured according to ASTM D3107.

In the present disclosure, stretch according to ASTM D3107 was measured by means of a 1.35 kg (3.0 lb) weight.

According to embodiments of the invention, the biopolymer-producing microorganisms are selected from bacteria, algae, yeast, fungi and mixtures thereof, optionally genetically modified microorganisms.

According to embodiments, biopolymer-producing microorganisms are selected from biopolymer-producing bacteria, biopolymer-producing algae, and mixture thereof.

In particular, biopolymer-producing bacteria are selected from *Gluconacetobacter, Aerobacter, Acetobacter, Achromobacter, Agrobacterium, Azotobacter, Salmonella, Alcaligenes, Pseudomonas, Rhizobium, Sarcina* and *Streptoccoccus, Bacillus* genus, and mixtures thereof, and biopolymer-producing algae are selected from *Phaeophyta, Rhodophyta* and *Chrysophyta*, and mixture thereof.

For example, microbial cellulose, e.g. bacterial cellulose, can be produced by culturing strains of *Acetobacter* bacteria, such as strains of *Acetobacter xylinum*, and/or by culturing strains of *Gluconacetobacter*, such as strains of *Gluconacetobacter hansenii*.

For example, microbial collagen, in particular bacterial collagen can be produced by culturing bacterial strains of *Bacillus, Pseudomonas, Streptoccoccus* or bacterial strains which have been genetically modified to obtain modified strains that produce collagen.

For example, microbial cellulose/chitin copolymer, e.g. bacterial cellulose/chitin copolymer can be produced by culturing strains of *Acetobacter xylinum* which have been genetically modified to obtain modified strains that produce microbial cellulose/chitin copolymer.

According to exemplary embodiments of the invention, the biopolymer-producing microorganisms, i.e., the microbial biopolymer-producing microorganisms, are a mixture of wild type and genetically modified microorganisms; for example a mixture of wild type and genetically modified bacteria.

It is also an object of the present invention a composite textile article as obtainable with a process according to the invention, wherein the composite textile article includes a textile softening agent.

All the features disclosed herein with reference to the process of the invention, apply mutatis mutandis also to the composite textile article obtainable with said process.

According to embodiments, the textile softening agent is micro-silicone softening agent. In other words, according to embodiments, the composite textile article includes a micro-silicone softening agent, as above defined.

According to embodiments, the textile article is selected from a fiber, a yarn, a fabric and a garment. In other words, a composite textile article including a textile softening agent as obtainable with a process according to the invention may be a composite fiber, a composite yarn, a composite fabric or a composite garment.

According to embodiments, weight of a composite fabric as obtainable with a process according to the invention may be in the range of from 50 g/m$^2$ to 1000 g/m$^2$, preferably from 90 g/m$^2$ to 600 g/m$^2$, more preferably from 150 g/m$^2$ to 500 g/m$^2$, even more preferably from 170 g/m$^2$ to 450 g/m$^2$ measured according to ASTM D 3776, before wash.

Advantageously, the present invention allows to obtain composites fabrics that can be stretched weftwise and/or warpwise up to 50%, measured according to ASTM D3107, as above mentioned.

This is particularly true when the composite fabric includes microbial cellulose and a silicone softening agent. In fact, without being bound to a specific scientific explanation, it has been observed that by treating a composite textile article including microbial cellulose with a softening agent, in particular with a silicone softening agent, the friction coefficient between the fibers of microbial cellulose may by significantly reduced, so that, after the treatment with a softening agent, tearing or cracking of the microbial cellulose in the composite textile article is substantially reduced or avoided, even when the article is stretched.

According to embodiments, when the textile article is a fabric, the fabric may be an elastic, stretchable, fabric. In this case, advantageously, an elastic, stretchable composite fabric may be obtained.

According to embodiments, the composite textile article may be an elastic, stretchable, composite fabric.

According to embodiments, the composite fabric can be stretched, without tearing or cracking the biopolymer (e.g, the microbial cellulose), up to 25%, measured according to ASTM D3107.

In some cases, according to embodiments, the composite fabric can be stretched up to 50%, measured according to ASTM D3107.

In the present disclosure, stretch according to ASTM D3107 was measured by means of a 1.35 kg (3.0 lb) weight.

According to preferred embodiments, the composite textile article is dyed, preferably indigo dyed.

According to embodiments, the composite textile article is a composite garment which comprises a composite fabric including a biopolymer (for example, bacterial cellulose) and a textile softening agent, wherein, at least part of the biopolymer layer is dyed, more preferably indigo dyed. Preferably, the biopolymer layer is on the front side of the fabric, i.e., the side of the fabric which is the external visible side when a garment comprising the fabric is worn.

According to embodiments, the biopolymer layer may be on the back side of the fabric, i.e., the side of the fabric which is the internal not visible side when a garment comprising the fabric is worn.

According to embodiments, the biopolymer layer may be on both the front side and the back side of the fabric, i.e., on both the side of the fabric which is the external visible side when a garment comprising the fabric is worn and the side of the fabric which is the internal not visible side when a garment comprising the fabric is worn.

EXPERIMENTAL SECTION

Example 1—Fabric Provided With Bacterial Cellulose and Subsequently Impregnated With Silicone Softener 25*35 cm samples of fabric were prepared.

A 1200 ml culture of bacterial cellulose-producing bacteria was incubated, in a cotton covered flask, for 2 days at 200 rpm and 28° C.

The culture was filter by using a scrim to remove the formed bacterial cellulose fibers.

The filtered culture was poured or sprayed on the fabric samples and incubated for 18 hours, to obtain fabric samples provided with a bacterial cellulose layer.

Bacterial cellulose-provided fabric samples were washed with 0.1M NaOH at 80° C. for 20 min and neutralized in distilled water.

Bacterial cellulose-provided fabric samples were incubated in mixtures comprising 10-40% weight percent of silicone (SANSIL MIC 3145, micro-silicone), 200 g of mixtures for 10 g of sample, at 36° C. and 100 rpm for 18 hours.

Samples of composite fabric including a bacterial cellulose layer and a micro-silicone softening agent are obtained.

The samples were dried

Example 2—Silicone Softener Added Into Bacterial Cellulose Culture Medium and Then Growing a Silicone Softener-Containing Bacterial Cellulose Layer on a Fabric 25*35 cm samples of fabric were prepared.

A 1200 ml culture of bacterial cellulose-producing bacteria was incubated, in a cotton covered flask, for 2 days at 200 rpm and 28° C.

The culture was filter by using a scrim to remove the formed bacterial cellulose fibers.

1% (w/w) of silicone softening agent (SANSIL MIC 3145, micro-silicone) was added into the culture, i.e., into the culture medium.

The filtered, silicone-containing culture was poured or sprayed onto fabric samples and incubated for 18 hours, to obtain samples of composite fabric including a bacterial cellulose layer and a micro-silicone softening agent.

Obtained samples of composite fabric including a bacterial cellulose layer and a micro-silicone softening agent were washed in 0.1M NaOH at 80° C. for 20 min and neutralized in distilled water.

The samples were dried.

Example 3—Fabric Stiffness Analysis

A sample of composite fabric including a bacterial cellulose layer and a micro-silicone softening agent was obtained according to the procedure of Example 1. In particular, the bacterial cellulose-coated fabric sample was incubated at 36° C. and 100 rpm for 18 hours in 10% weight percent of silicone softening agent (SANSIL MIC 3145, micro-silicone). The stiffness of the obtained sample (named "Bacterial Cellulose coated fabric+10% Silicone treatment for 18 hours") was measured according to standard ASTM D4032.

For comparison, it was measured the stiffness (according to standard ASTM D4032) of:

- sample fabric alone (sample named "Control Fabric");
- sample fabric, without the bacterial cellulose layer, incubated with 10% weight percent of silicone softening agent (SANSIL MIC 3145, micro-silicone) (sample named "Control Fabric+10% Silicone treatment for 18 hours");
- sample fabric provided with a bacterial-cellulose layer, not incubated with the silicone softening agent (sample named "Bacterial Cellulose coated fabric").

| Treatment Type | Stiffness (ASTM D4032) |
|---|---|
| Control Fabric | 0.59 |
| Control Fabric + 10% Silicone treatment for 18 hours | 0.58 |
| Bacterial Cellulose coated fabric | 1.53 |
| Bacterial Cellulose coated fabric + 10% Silicone treatment for 18 hours | 0.96 |

As can be observed from the data in the table above, the treatment with a mixture comprising 10% by weight of silicone softening agent, does not substantially modify the stiffness of the sample fabric, when the fabric is not provided with a bacterial cellulose layer.

Conversely, the treatment with the silicone softening agent reduces the stiffness of composite fabric samples comprising a bacterial cellulose layer.

In particular, the stiffness of a composite fabric sample including a bacterial cellulose layer and a silicone softening agent is 0.96 while the stiffness of a composite fabric sample including a bacterial cellulose layer but not including a silicone softening agent is 1.53, the stiffness being measured according to standard method ASTM D4032.

Accordingly, the stiffness of a composite fabric sample including a bacterial cellulose layer and a silicone softening agent is about 37% lower than the stiffness of a composite fabric sample including a bacterial cellulose layer but not including a silicone softening agent.

In other words, a composite fabric sample including a bacterial cellulose layer and a silicone softening agent is more flexible than a composite fabric sample including a bacterial cellulose layer but not including a silicone softening agent.

The invention claimed is:

1. A process for the production of a composite textile which includes at least a biopolymer layer, comprising the following steps:

a. providing at least one textile;

b. contacting at least part of said textile with a culture comprising biopolymer-producing microorganisms and a silicone softening agent, and culturing said biopolymer-producing microorganisms and said silicone softening agent to obtain a biopolymer layer on said textile, wherein said silicone is selected from the group consisting of macro-silicone, semi-micro silicone, micro-silicone and nano-silicone.

2. The process according to claim 1, wherein said micro-silicone is an emulsion and has a particle size from 10 nm to 40 nm, as measured by Dynamic Light Scattering.

3. The process according to claim 1, wherein said biopolymer is a sugar-based biopolymer, an amino acid-based biopolymer, or a mixture thereof.

4. The process according to claim 1, wherein said biopolymer is bacterial cellulose.

5. The process according to claim 1, wherein said textile is selected from the group consisting of a fiber, a yarn, a fabric and a garment.

6. The process according to claim 5, wherein said textile is a yarn having linear density ranging from 60 dtex to 2000 dtex.

7. The process according to claim 1, wherein said textile is elastic.

8. The process according to claim 1, wherein said biopolymer-producing microorganisms are selected from the group consisting of bacteria, algae, yeast, fungi, genetically modified strains thereof and mixtures thereof.

9. The process according to claim 8, wherein said biopolymer-producing bacteria are selected from the group consisting of *Gluconacetobacter, Aerobacter, Acetobacter, Achromobacter, Agrobacterium, Azotobacter, Salmonella, Alcaligenes, Pseudomonas, Rhizobium, Sarcina, Streptococcus, Bacillus* , and mixtures thereof, and said biopolymer-producing algae are selected from the group consisting of *Phaeophyta, Rhodophyta, Chrysophyta,* and mixture thereof.

10. The process according to claim 1, wherein said silicone is a micro-silicone.

11. The process according to claim 3, wherein said sugar-based biopolymer is a microbial cellulose.

12. The process according to claim 3, wherein said amino acid-based biopolymer is a microbial collagen or a bacterial collagen.

13. The process according to claim 7, wherein said elastic textile is a woven fabric or a denim fabric.

14. The process according to claim 1, wherein said culture comprises said silicone softening agent in an amount ranging from 0.5% to 2% by weight of the final culture.

15. The process according to claim 1, wherein at least part of said biopolymer layer is dyed.

* * * * *